US009125276B2

(12) United States Patent
Lee

(10) Patent No.: US 9,125,276 B2
(45) Date of Patent: Sep. 1, 2015

(54) BACKLIGHT UNIT INCLUDING FIRST AND SECOND DRIVING CURRENTS AND DISPLAY APPARATUS USING THE SAME

(75) Inventor: Sang-hoon Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 201 days.

(21) Appl. No.: 12/847,379

(22) Filed: Jul. 30, 2010

(65) Prior Publication Data

US 2011/0175938 A1 Jul. 21, 2011

(30) Foreign Application Priority Data

Jan. 15, 2010 (KR) ..... 10-2010-0003758

(51) Int. Cl.
*G09G 3/36* (2006.01)
*H05B 33/08* (2006.01)
*G09G 3/34* (2006.01)

(52) U.S. Cl.
CPC ..... *H05B 33/086* (2013.01); *G09G 3/3406* (2013.01); *G09G 2310/0237* (2013.01); *G09G 2310/08* (2013.01); *G09G 2320/0238* (2013.01); *G09G 2320/064* (2013.01); *G09G 2320/0633* (2013.01); *G09G 2330/021* (2013.01); *G09G 2360/16* (2013.01)

(58) Field of Classification Search
CPC ..... G09G 3/3413
USPC ..... 345/102
See application file for complete search history.

(56) References Cited

U.S. PATENT DOCUMENTS

| | | | | |
|---|---|---|---|---|
| 7,161,577 | B2 * | 1/2007 | Hirakata et al. | 345/102 |
| 7,839,096 | B2 * | 11/2010 | Kim et al. | 345/102 |
| 2002/0036608 | A1 * | 3/2002 | Hirakata et al. | 345/87 |
| 2002/0067332 | A1 * | 6/2002 | Hirakata et al. | 345/102 |
| 2005/0168564 | A1 * | 8/2005 | Kawaguchi et al. | 347/237 |
| 2005/0243052 | A1 * | 11/2005 | Lim | 345/102 |
| 2006/0082538 | A1 * | 4/2006 | Oyama | 345/102 |
| 2006/0187181 | A1 * | 8/2006 | Kim | 345/102 |
| 2006/0187183 | A1 * | 8/2006 | Naka et al. | 345/102 |
| 2006/0232216 | A1 | 10/2006 | Kosaka | |
| 2006/0284894 | A1 * | 12/2006 | Johnson et al. | 345/690 |
| 2007/0115209 | A1 | 5/2007 | Maejima | |
| 2007/0182701 | A1 * | 8/2007 | Kim et al. | 345/102 |
| 2007/0257880 | A1 * | 11/2007 | Nakao et al. | 345/102 |

(Continued)

FOREIGN PATENT DOCUMENTS

| | | | | |
|---|---|---|---|---|
| EP | 0 261 896 | A2 | 3/1988 | |
| JP | 2008-152008 | * | 7/2008 | G09G 3/36 |

OTHER PUBLICATIONS

Extended European Search Report dated Jul. 8, 2011 from the European Patent Office in counterpart European Patent Application No. 10193255.6.

*Primary Examiner* — Adam J Snyder
(74) *Attorney, Agent, or Firm* — Sughrue Mion, PLLC

(57) ABSTRACT

A backlight unit and a display apparatus are provided. The display apparatus includes a driving unit which applies a driving current using a duty cycle controlling to the light emitting unit; and a controller which controls a first driving current to be applied to the light emitting unit in a section of a plurality of frame sections, and a second driving current to be applied to the light emitting unit in another section of the plurality of frame sections. Therefore, luminance representation of backlight in a low grayscale region can be improved.

12 Claims, 7 Drawing Sheets

(56) References Cited

U.S. PATENT DOCUMENTS

| | | | | |
|---|---|---|---|---|
| 2008/0068359 | A1* | 3/2008 | Yoshida et al. | 345/87 |
| 2008/0180386 | A1* | 7/2008 | Liao et al. | 345/102 |
| 2008/0284692 | A1* | 11/2008 | Chao et al. | 345/102 |
| 2009/0051712 | A1 | 2/2009 | Arai et al. | |
| 2009/0243496 | A1* | 10/2009 | Lee et al. | 315/158 |
| 2009/0322235 | A1* | 12/2009 | Shiu et al. | 315/307 |
| 2010/0020008 | A1* | 1/2010 | Kobayashi et al. | 345/102 |
| 2010/0201282 | A1* | 8/2010 | Yu et al. | 315/287 |

* cited by examiner

BACKLIGHT UNIT INCLUDING FIRST AND SECOND DRIVING CURRENTS AND DISPLAY APPARATUS USING THE SAME

CROSS-REFERENCE TO RELATED APPLICATIONS

This application claims priority under 35 U.S.C. §119 from Korean Patent Application No. 10-2010-0003758, filed on Jan. 15, 2010, in the Korean Intellectual Property Office, the disclosure of which is incorporated herein by reference in its entirety.

BACKGROUND

1. Field

Apparatuses and methods consistent with exemplary embodiments relate to a backlight unit and a display apparatus, and more particularly, to a backlight unit which displays an image using backlight radiated from a light emitting module of a display and a display apparatus having the same.

2. Description of the Related Art

A liquid crystal display (LCD) which is widely used cannot emit light for itself. Therefore, an LCD panel needs to have a backlight unit which provides backlight to the LCD.

The backlight unit includes a light emitting unit which generates the backlight and a light guide plate which uniformly transmits the backlight radiated from the light emitting unit onto a panel surface of the LCD.

The light emitting unit includes light emitting elements which are disposed in order to efficiently provide the backlight to the LCD and a driving element which drives the light emitting elements. A proper number of driving elements are provided to drive the light emitting elements without any problems.

A display apparatus employs a method for adjusting the luminance of the backlight using a dimming control in order to enhance a contrast ratio of a display screen and to reduce power consumption. There are two kinds of the dimming control methods: the pulse width modulation (PWM) control method and the analog dimming control method.

The analog dimming control method adjusts the luminance of the backlight by controlling the amount of current applied to a light emitting unit. That is, if it is desired to decrease a brightness of the backlight by half, the display apparatus may reduce the amount of current applied to the light emitting unit by half to adjust the brightness.

The PWM control method adjusts the luminance of the backlight by controlling ON/OFF switching of the light emitting unit. That is, if a PWM signal having an ON/OFF ratio of 4 to 1 is provided to the light emitting unit, the light emitting unit may present a maximum of 80% brightness.

Since the analog dimming control method is disadvantageous in that it is difficult to adjust the luminance using a low current, a display apparatus adjusts the luminance of the backlight using a PWM control method. However, even if luminance of backlight is adjusted using the PWM control method, the luminance representation may be deteriorated in a low grayscale region since it is impossible for a dimming frequency to be increased limitlessly.

Therefore, there is a need for methods which enhance luminance representation of backlight.

SUMMARY OF THE EXEMPLARY EMBODIMENTS

Exemplary embodiments address at least the above problems and/or disadvantages and other disadvantages not described above. Also, the exemplary embodiments are not required to overcome the disadvantages described above, and an exemplary embodiment may not overcome any of the problems described above.

The exemplary embodiments provide a backlight unit which applies a driving current to a light emitting unit in some sections and another driving current to the light emitting unit in other sections within a frame having a plurality of sections, and a display apparatus.

According to an exemplary embodiment, there is provided a display apparatus, including an image processing unit which processes a signal of an input image; a display panel which displays the processed image; and a backlight unit (BLU) which provides the display panel with backlight, wherein the backlight unit may include a light emitting unit; and a backlight driving unit which drives the light emitting unit, wherein the backlight driving unit may include a driving unit which applies a driving current using a duty cycle to control the light emitting unit; and a controller which, in a frame having a plurality of sections, controls a first driving current to be applied to the light emitting unit in some sections, and a second driving current to be applied to the light emitting unit in other sections.

The controller may adjust the first driving current and the second driving current applied to the light emitting unit.

The controller may control the first driving current to be greater than the second driving current, and to be applied to the light emitting unit.

The first driving current may be applied to the light emitting unit to output 1 grayscale, and the second driving current may be applied to the light emitting unit to output a grayscale less than 1 grayscale.

The controller may control the second driving current to be 50% of the first driving current, and to be applied to the light emitting unit.

The first driving current may be applied to the light emitting unit to output 1 grayscale, and the second driving current may be applied to the light emitting unit to output 0.5 grayscale.

The controller may control the first driving current and the second driving current to differ from each other and to be applied to the light emitting unit only when the frame is a low luminance image frame.

According to another exemplary embodiments, there is provided a backlight unit (BLU), including a light emitting unit; and a backlight driving unit which drives the light emitting unit, wherein the backlight driving unit may include a driving unit which applies a driving current using a duty cycle to control the light emitting unit; and a controller which, in a frame having a plurality of sections, controls a first driving current to be applied to the light emitting unit in some sections, and a second driving current to be applied to the light emitting unit in other sections.

The controller may adjust the first driving current and the second driving current applied to the light emitting unit.

The controller may control the first driving current to be greater than the second driving current, and to be applied to the light emitting unit.

The first driving current may be applied to the light emitting unit to output 1 grayscale, and the second driving current may be applied to the light emitting unit to output a grayscale less than 1 grayscale.

The controller may control the second driving current to be 50% of the first driving current, and to be applied to the light emitting unit.

The first driving current may be applied to the light emitting unit to output 1 grayscale, and the second driving current may be applied to the light emitting unit to output 0.5 grayscale.

The controller may control the first driving current and the second driving current to differ from each other and to be applied to the light emitting unit only when the frame is a low luminance image frame.

BRIEF DESCRIPTION OF THE DRAWINGS

The above and/or other aspects will be more apparent by describing certain exemplary embodiments with reference to the accompanying drawings, in which.

DETAILED DESCRIPTION OF THE EXEMPLARY EMBODIMENTS

Figure 1:
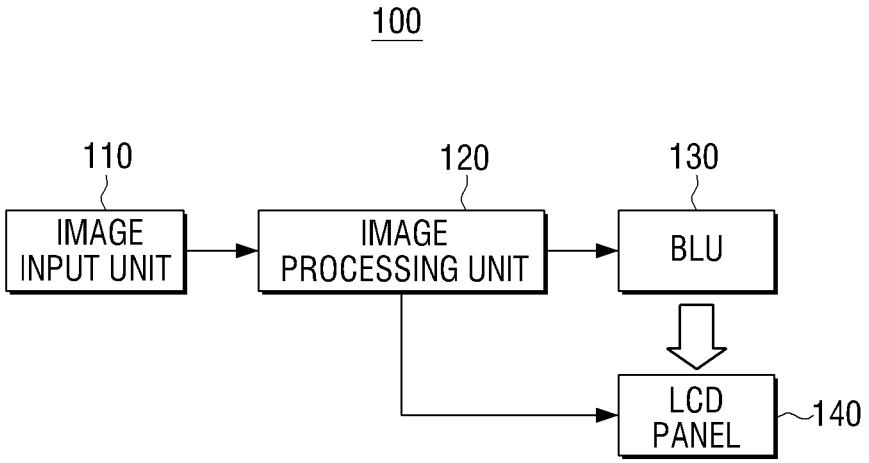
FIG. 1 is a block diagram illustrating a liquid crystal display (LCD) apparatus according to an exemplary embodiment.

Certain exemplary embodiments will now be described in greater detail with reference to the accompanying drawings.

In the following description, the same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

FIG. 1 is a block diagram illustrating a liquid crystal display (LCD) apparatus 100 according to an exemplary embodiment. Referring to FIG. 1, the LCD apparatus 100 includes an image input unit 110, an image processing unit 120, a backlight unit (BLU) 130, and an LCD panel 140.

The image input unit 110 includes an interface to be connected to an external device or an external system via a wireless and/or wired connection, and receives an image from the external device or the external system. The image input unit 110 transmits the input image to the image processing unit 120.

The image processing unit 120 generates an image signal which is converted into a proper format for the LCD panel 140 and a brightness controlling signal which enables local dimming of the backlight unit 130. The image processing unit 120 processes a signal which allows a light emitting unit (not shown) of the backlight unit 130 to operate, and then transmits the signal to the backlight unit 130.

The backlight unit 130 receives the signal generated by the image processing unit 120, drives a light emitting unit 135 (illustrated in FIG. 2), and emits backlight onto the LCD panel 140, since the LCD panel 140 cannot emit light for itself.

The backlight unit 130 controls the amount of current applied to the light emitting unit 135 using a pulse width modulation (PWM) control method in order to adjust the luminance of a single frame of an image input to the LCD apparatus 100.

Specifically, for a single frame having a plurality of sections, the backlight unit 130 applies a first driving current to some sections, and a second driving current to other sections. In this situation, the first driving current is different from the second driving current. In doing so, the backlight unit 130 may enhance luminance representation in a low grayscale region. A method for adjusting the luminance of a backlight by applying different driving current to each section will be explained later in detail with reference to FIGS. 3 to 5B.

The LCD panel 140 adjusts transmittance of the backlight produced by the backlight unit 130 to visualize an image signal, and displays an image on a screen. The LCD panel 140 is configured in such a manner that two substrates on which electrodes are formed are disposed to face each other, and a liquid crystal material is injected between the two substrates. If voltage is applied to the two electrodes, an electric field is formed on the substrates causing molecules of the liquid crystal material injected between the two substrates to move, thereby adjusting the transmittance of the backlight.

Figure 2:
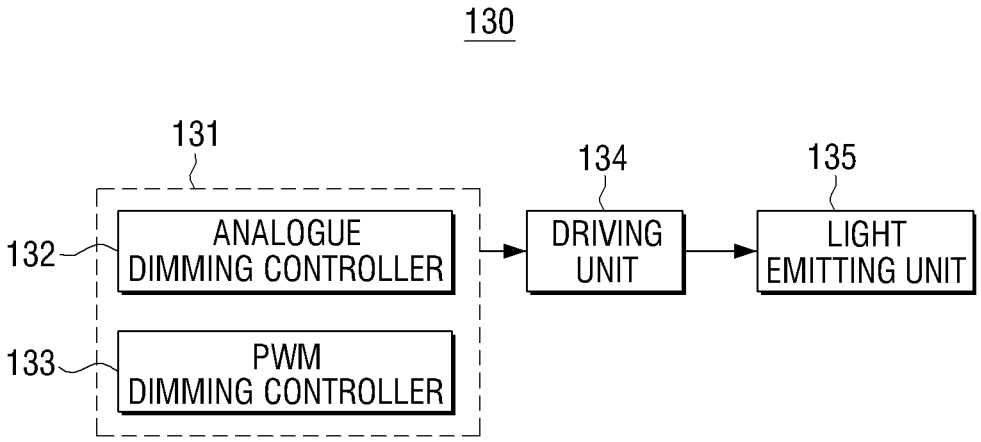
FIG. 2 is a block diagram illustrating a backlight unit of an LCD apparatus according to an exemplary embodiment.

FIG. 2 is a block diagram illustrating the backlight unit 130 of the LCD apparatus 100 according to an exemplary embodiment.

Referring to FIG. 2, the backlight unit 130 includes a controller 131, a driving unit 134, and a light emitting unit 135. The controller 131 includes an analog dimming controller 132 and a PWM dimming controller 133.

The analog dimming controller 132 controls the amount of current applied to the light emitting unit 135 for each section. To be specific, the analog dimming controller 132 generates a control signal which causes the first driving current to be applied to the light emitting unit 135 in the first dimming section and the second driving current to be applied to the light emitting unit 135 in the second dimming section, and then transfers the control signal to the driving unit 134.

The first driving current represents the amount of driving current applied to the light emitting unit 135 to output backlight having 1 grayscale, the second driving current represents the amount of driving current applied to the light emitting unit 135 to output backlight having 0.5 grayscale. Therefore, the amount of the second driving current is half the amount of the first driving current. However, the exemplary embodiments are not limited thereto.

The PWM dimming controller 133 generates a PWM dimming signal of a driving current input to the light emitting unit 135, and controls the driving unit 134. Specifically, the PWM dimming controller 133 controls ON/OFF switching of the PWM dimming signal provided to the driving unit 134, and controls a PWM duty ratio. The light emitting unit 135 may adjust the luminance of the backlight output through the PWM dimming signal.

The driving unit 134 applies a driving current to the light emitting unit 135 according to a control signal of the analog dimming controller 132 and a PWM dimming signal of the PWM dimming controller 133. A method for applying a driving current to the light emitting unit 135 according to a control signal of the analog dimming controller 132 and a PWM dimming signal of the PWM dimming controller 133 will be explained later in detail with reference to FIG. 3.

The light emitting unit 135 receives a driving current from the driving unit 134, and emits backlight. The light emitting unit 135 includes a plurality of light emitting elements, and the light emitting element may be implemented as a light emitting diode (LED), a cold cathode fluorescent lamp (CCFL), or the like, but is not limited thereto. The light emitting unit 135 provides backlight having different luminance according to the applied current and the ON/OFF ratio of a PWM dimming signal.

Hereinbelow, a method of applying a driving current by the driving unit 134 to the light emitting unit 135 according to a control signal of an analog dimming controller 132 and a PWM dimming signal of the PWM dimming controller will be explained in detail with reference to FIG. 3.

Figure 3:
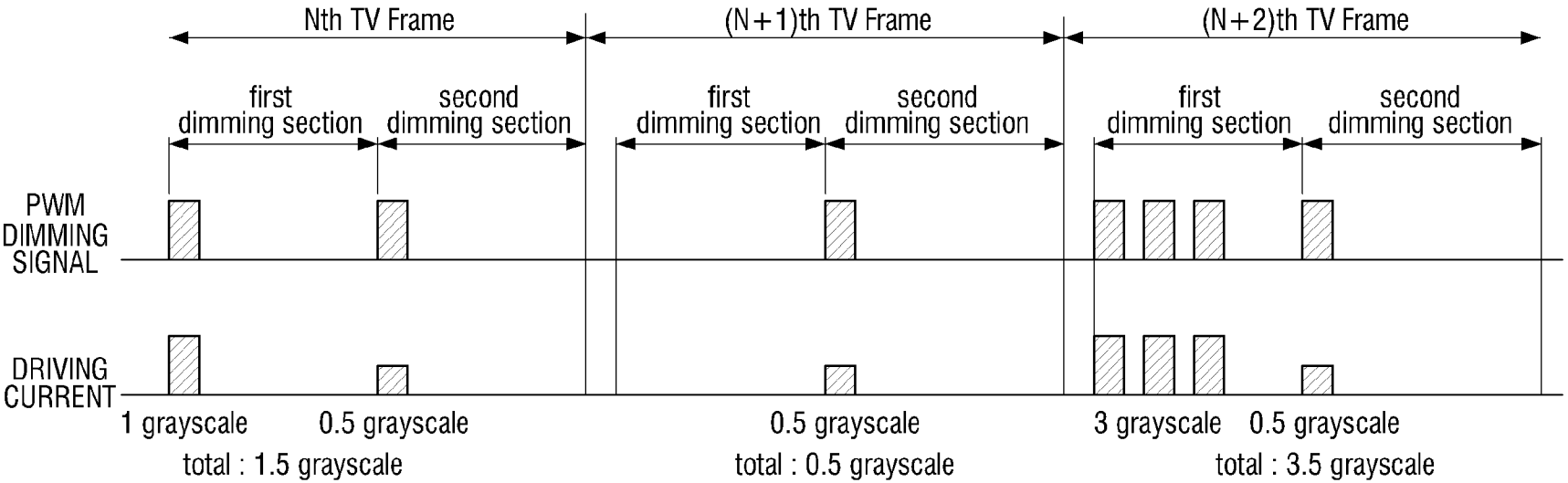
FIG. 3 is a view provided to explain a method for applying a driving current to a light emitting unit to enhance luminance representation according to an exemplary embodiment.

FIG. 3 is a view provided to explain a method for applying a driving current to the light emitting unit 135 in order to enhance luminance representation of the light emitting unit 135.

As shown in FIG. 3, the LCD apparatus 100 shows TV frames from $N^{th}$ to $(N+2)^{th}$. In particular, the graph representing the $N^{th}$ TV frame exhibits a PWM dimming signal for outputting backlight having luminance of 1.5 grayscale and the amount of current applied to the light emitting unit 135. The graph representing $N+1^{th}$ TV frame exhibits a PWM dimming signal for outputting backlight having luminance of 0.5 grayscale and the amount of current applied to the light emitting unit 135. The graph representing $N+2^{th}$ TV frame exhibits a PWM dimming signal for outputting backlight having luminance of 3.5 grayscale and the amount of current applied to the light emitting unit 135.

In the graph representing $N^{th}$ TV frame, the first and second dimming sections each include one pulse, and thus in the $N^{th}$ TV frame, the current enabling backlight having luminance of 1.5 grayscale to be radiated is applied to the light emitting unit 135. Therefore, the LCD apparatus 100 outputs backlight having luminance of 1.5 grayscale. A control signal of the analog dimming controller 132 causes the first driving current to be applied to the light emitting unit 135 in the first dimming section in order to display 1 grayscale, and the second driving current to be applied to the light emitting unit 135 in the second dimming section in order to display 0.5 grayscale.

In the $N+1^{th}$ TV frame, since a pulse exists only in the second dimming section, and not in the first dimming section, the driving current enabling 0.5 grayscale to be output is applied to the light emitting unit 135. Therefore, the LCD apparatus 100 may output backlight having luminance of 0.5 grayscale.

Likewise, in the $N+2^{th}$ TV frame, since three pulses exist in the first dimming section, and one pulse exists in the second dimming section, the driving current enabling 3.5 grayscale to be output is applied to the light emitting unit 135. Therefore, the LCD apparatus 100 may output backlight having luminance of 3.5 grayscale.

According to the above operation, the LCD apparatus 100 may output not only backlight having luminance of an integer grayscale but also backlight having luminance of a half-integer grayscale. In particular, if backlight is output in a low grayscale region according to the above operation, the LCD apparatus 100 may enhance luminance representation.

Figure 4A:
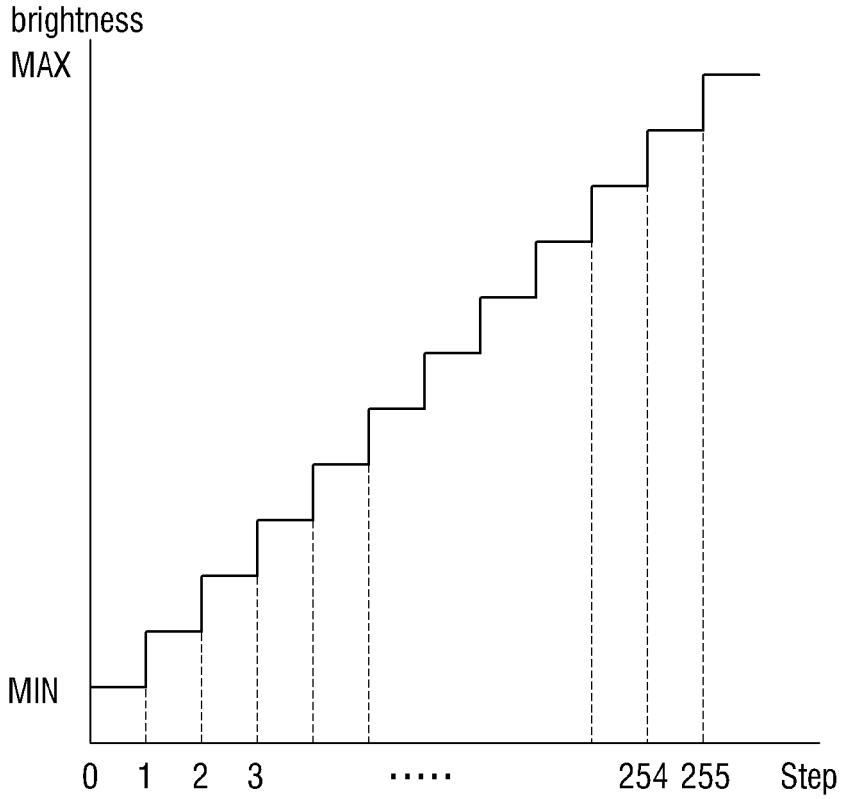
FIG. 4A (RELATED ART)
FIG. 4A is a graph illustrating luminance representation of backlight according to a related art method for applying a driving current.
Figure 4B:
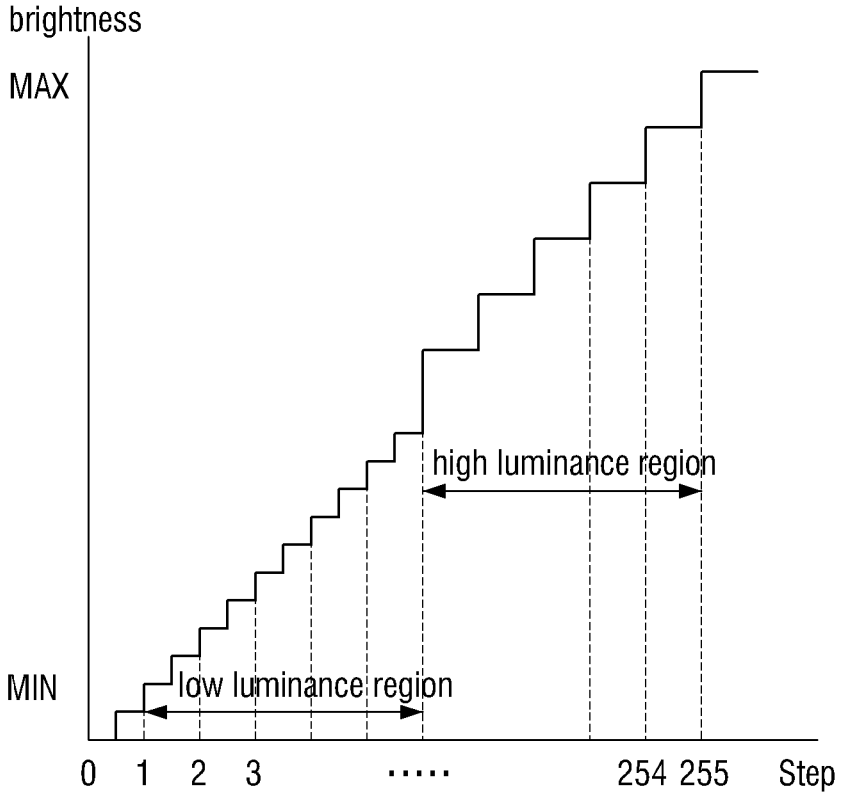
FIG. 4B is a graph illustrating luminance representation of backlight according to a present method for applying a driving current.

FIG. 4A is a graph illustrating luminance representation of backlight according to a related art method for applying a driving current, and FIG. 4B is a graph illustrating luminance representation of backlight according to the exemplary embodiment.

As shown in FIGS. 4A and 4B, if a grayscale is 8 bit, the luminance of the backlight may be represented from 1 grayscale to 255 grayscale.

In a related art method, a grayscale is represented by 1 as shown in FIG. 4A. That is, the related art method applies the same driving current to the light emitting unit 135 for every pulse, thereby outputting backlight having luminance of an integer grayscale such as 1, 2, 3, . . . 255. However, according to the exemplary embodiment, a grayscale is represented by 0.5 as shown in FIG. 4B. That is, the exemplary embodiment may output backlight having luminance of a half-integer grayscale such as 0.5, 1, 1.5, . . . , 254.5, 255.

Accordingly, the LCD apparatus 100 according to the exemplary embodiment may output backlight having dense luminance, thereby enhancing the luminance representation of the backlight.

Also, the method for applying the driving current according to the exemplary embodiment may be applied to only the low luminance region as shown in FIG. 4B. Herein, the low luminance region refers to the region where the luminance of the backlight is 50% or less than the maximum luminance of backlight. A user is not sensitive to luminance variation in the region having luminance of 50% or more than the maximum luminance of backlight, but is sensitive to luminance variation in the region having luminance of 50% or less than the maximum luminance of backlight. Therefore, the LCD apparatus 100 according to the exemplary embodiment may apply a different driving current for each of a plurality of dimming sections only in the low luminance region.

Figure 5A:
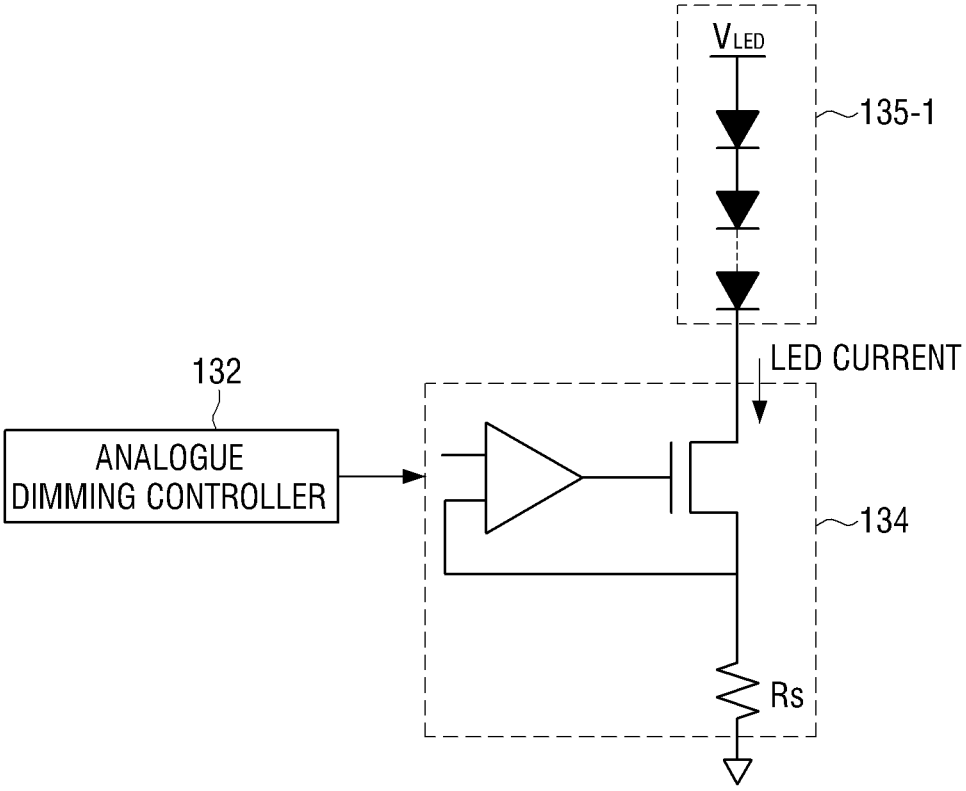
FIG. 5A is a circuit diagram illustrating a part of a backlight unit according to an exemplary embodiment.
Figure 5B:
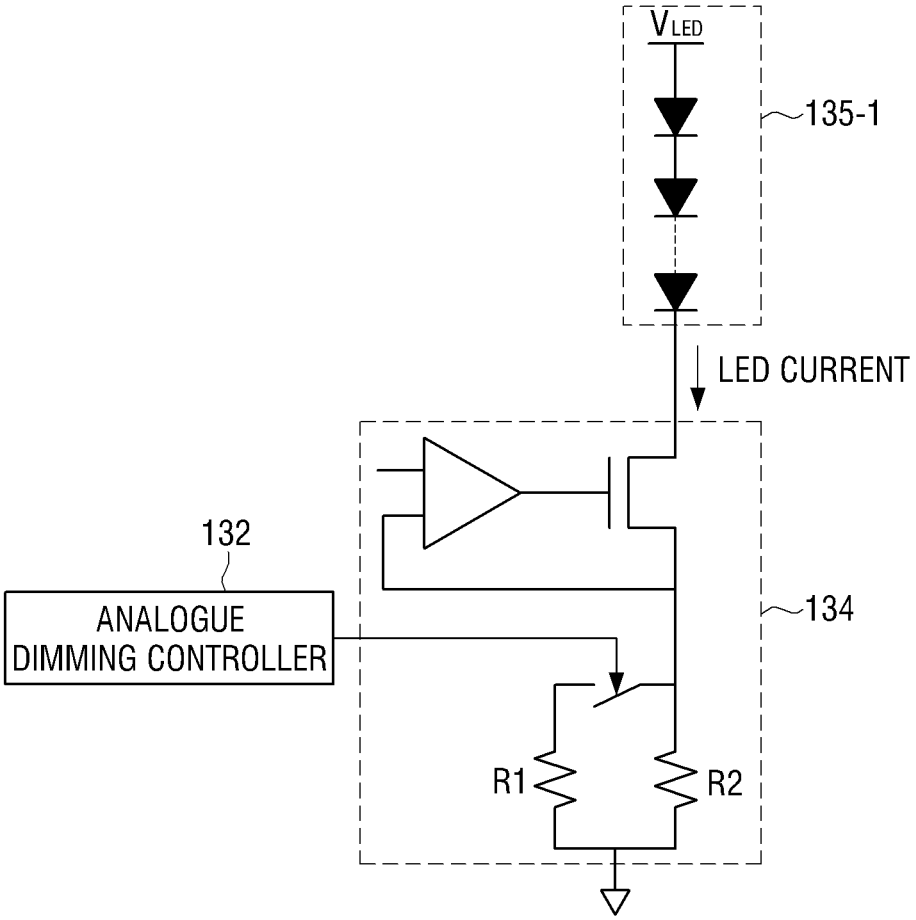
FIG. 5B is a circuit diagram illustrating a part of a backlight unit according to another exemplary embodiment.

FIGS. 5A and 5B are circuit diagrams illustrating a part of a backlight unit for applying a different driving current to each of a plurality of dimming sections according to an exemplary embodiment.

In the circuit illustrated in FIG. 5A, the analog dimming controller 132 directly controls a driving current which is applied to an LED 135-1. Specifically, the analog dimming controller 132 controls the driving unit 134 so that the first driving current is applied to the LED 135-1 in the first dimming section, and the second driving current is applied to the LED 135-1 in the second dimming section. The analog dimming controller 132 controls the driving current applied to the LED 135-1, and thus the LCD apparatus 100 may cause a different driving current to be applied to the LED 135-1 for each of the plurality of dimming sections.

The circuit illustrated in FIG. 5B controls a driving current using current sensing resistors R1, R2. That is, the analog dimming controller 132 controls a driving current by switching between the two current sensing resistors R1, R2 which are connected to each other in parallel. To be specific, the analog dimming controller 132 turns on a switch between the resistors R1, R2 in the first dimming section to sense the first current through the current sensing resistors R1, R2, and turns off the switch between the resistors R1, R2 in the second dimming section to sense the second current through the current sensing resistors R1, R2. As described above, the analog dimming controller 132 switches between the two current sensing resistors R1, R2 which are connected to each other in parallel, and thus the LCD apparatus 100 may apply a different driving current to the LED 135-1 for each of the plurality of dimming sections.

The LCD apparatus 100 is provided as a display apparatus in this exemplary embodiment, but this is merely exemplary. Any display apparatus which needs backlight, other than the LCD apparatus 100, may be applied according to the technical aspects of the exemplary embodiment.

The LED is described as the light emitting unit 135 in this exemplary embodiment, but this is merely exemplary. The technical aspects of the exemplary embodiments may be applied to other light emitting units besides the LED.

The plurality of dimming sections include two dimming sections in this exemplary embodiment, but this is merely exemplary. Alternatively, two or more dimming sections may be applied according to the technical aspects of the exemplary embodiment.

Two kinds of driving current are provided to represent 0.5 grayscale in this exemplary embodiment, but this is merely exemplary. Any driving current which can represent a grayscale less than 1 grayscale, other than 0.5 grayscale, may be applied according to the technical aspects of the exemplary embodiment.

The technical aspects of the exemplary embodiments may be applied when only the backlight unit besides the display apparatus is implemented.

As described above, according to the exemplary embodiments, the luminance representation of backlight in a low grayscale region may be enhanced.

The foregoing exemplary embodiments are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A display apparatus, comprising:

an image processing unit which processes a signal of an input image to output a processed image;

a display panel which displays the processed image; and a backlight unit (BLU) which provides the display panel with backlight, wherein the backlight unit comprises:

a light emitting unit which emits light on the display panel;

a backlight driving unit which applies different driving current to the same light emitting unit using a duty cycle which controls the light emitting unit;

a controller which controls the driving current applied to the light emitting unit, and comprises:

a pulse width modulation (PWM) dimming controller configured to generate a PWM dimming signal as the duty cycle to control the light emitting unit, and an analog dimming controller configured to control, in a frame having a plurality of dimming sections, the backlight driving unit to generate a first driving current to output an integer grayscale in a first dimming section and a second driving current to output a half-integer grayscale in a second dimming section, wherein the first driving current and the second driving current are different from each other and both to be applied to the light emitting unit only when the frame includes a low grayscale region, and the second dimming section refers to a plurality of dimming sections constituting the low luminance image frame exclusive of the first dimming section.

2. The display apparatus as claimed in claim 1, wherein the light emitting unit is a diode and wherein the controller adjusts the first driving current applied to the diode, and the second driving current applied to the diode.

3. The display apparatus as claimed in claim 1, wherein the controller controls the first driving current to be greater than the second driving current, and applies the first driving current to the light emitting unit.

4. The display apparatus as claimed in claim 1, wherein the controller controls the second driving current to be 50% of the first driving current, and applies the second driving current to the light emitting unit.

5. The display apparatus as claimed in claim 1, wherein the light emitting unit emits light of the same color onto the display panel.

6. A backlight unit (BLU), comprising:

a light emitting unit which emits light;

a backlight driving unit which applies different driving current to the same light emitting unit using a duty cycle which controls the light emitting unit;

a controller which controls the driving current applied to the light emitting unit, and comprises:

a pulse width modulation (PWM) dimming controller configured to generate a PWM dimming signal as the duty cycle to control the light emitting unit, and an analog dimming controller configured to control, in a frame having a plurality of dimming sections, the backlight driving unit to generate a first driving current to output an integer grayscale in a first dimming section and a second driving current to output a half-integer grayscale in a second dimming section, wherein the first driving current and the second driving current are different from each other and both to be applied to the light emitting unit only when the frame includes a low grayscale region, and the second dimming section refers to a plurality of dimming sections constituting the low luminance image frame exclusive of the first dimming section.

7. The backlight unit as claimed in claim 6, wherein the light emitting unit is a diode and wherein the controller adjusts the first driving current applied to the diode and the second driving current applied to the diode.

8. The backlight unit as claimed in claim 6, wherein the controller controls the first driving current to be greater than the second driving current, and applies the first driving current to the light emitting unit.

9. The backlight unit as claimed in claim 6, wherein the controller controls the second driving current to be 50% of the first driving current, and applies the second driving current to the light emitting unit.

10. A backlight unit (BLU) comprising:

a controller;

a light emitting unit; and a driving unit which applies a different driving current to the same light emitting unit using a duty cycle which controls the light emitting unit;

wherein the controller comprises:

a pulse width modulation (PWM) dimming controller configured to generate a PWM dimming signal as the duty cycle to control the light emitting unit, and an analog dimming controller configured to control, in a frame having a plurality of dimming sections, the driving unit to generate a first driving current in a first dimming section to output an integer grayscale in a first dimming section and a second driving current to output a half-integer grayscale in a second dimming section, wherein the first driving current and the second driving current are different from each other and both to be applied to the light emitting unit only when the frame includes a low grayscale region, the driving unit comprises at least two sensing resistors such that the driving current is switched by controlling a switch between the two current sensing resistors that are connected to each other in parallel, and the second dimming section refers to a plurality of dimming sections constituting the low luminance image frame exclusive of the first dimming section.

11. The backlight unit as claimed in claim 10, wherein the analog dimming controller generates a control signal which causes the first driving current to be applied to the light emitting unit in the first dimming section, and causes the second driving current to be applied to the light emitting unit in the second dimming section.

12. The backlight unit as claimed in claim 10, wherein the PWM dimming controller generates a PWM dimming signal of a driving current input to the light emitting unit and controls the driving unit.

* * * * *